US007934938B2

(12) United States Patent
Bandhu et al.

(10) Patent No.: US 7,934,938 B2
(45) Date of Patent: May 3, 2011

(54) CONNECTOR APPARATUS HAVING LOCKING MEMBER

(75) Inventors: Saujit Bandhu, Singapore (SG); Peng Seong Ang, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/376,280

(22) PCT Filed: Sep. 4, 2007

(86) PCT No.: PCT/US2007/077538

§ 371 (c)(1),
(2), (4) Date: Aug. 4, 2009

(87) PCT Pub. No.: WO2008/030808

PCT Pub. Date: Mar. 13, 2008

(65) Prior Publication Data

US 2009/0305547 A1 Dec. 10, 2009

(30) Foreign Application Priority Data

Sep. 8, 2006 (SG) ..... 200606213-7

(51) Int. Cl.
*H01R 13/627* (2006.01)

(52) U.S. Cl. ..... 439/352; 439/358

(58) Field of Classification Search ..... 439/352, 439/567, 345, 350

See application file for complete search history.

(56) References Cited

U.S. PATENT DOCUMENTS

| | | | | | |
|---|---|---|---|---|---|
| 4,678,256 | A * | 7/1987 | Nishino et al. | ..... | 439/347 |
| 4,693,533 | A * | 9/1987 | Szczesny et al. | ..... | 439/350 |
| 4,699,438 | A * | 10/1987 | Kikuta | ..... | 439/95 |
| 4,726,783 | A * | 2/1988 | Nakazawa et al. | ..... | 439/350 |
| 5,197,901 | A * | 3/1993 | Hashiguchi | ..... | 439/352 |
| 5,383,794 | A * | 1/1995 | Davis et al. | ..... | 439/352 |
| 5,435,744 | A * | 7/1995 | Derstine et al. | ..... | 439/352 |
| 5,713,752 | A * | 2/1998 | Leong et al. | ..... | 439/358 |
| 6,305,959 | B1 * | 10/2001 | Baker et al. | ..... | 439/188 |
| 6,398,567 | B1 * | 6/2002 | Nishimura | ..... | 439/159 |
| 6,565,383 | B1 | 5/2003 | Wu | | |
| 6,612,860 | B2 * | 9/2003 | Droesbeke | ..... | 439/357 |
| 6,761,580 | B2 | 7/2004 | Chang | | |
| 6,776,646 | B2 | 8/2004 | Lee | | |
| 6,991,487 | B2 * | 1/2006 | Wu | ..... | 439/358 |
| 2003/0096517 | A1 | 5/2003 | Ho | | |
| 2004/0175980 | A1 | 9/2004 | Poh et al. | | |

* cited by examiner

*Primary Examiner* — Michael C Zarroli
(74) *Attorney, Agent, or Firm* — Melanie G. Gover

(57) ABSTRACT

A connector for connecting with a serial ATA socket is described, the socket having end walls and an indent in each end wall. The connector has an insulated elongated member, the member having a first wall, an opposite second wall, first and second side walls and an insertion end. A plurality of contacts within the insulated elongated member extend in the direction of the insertion end. A locking member is located at least at one side wall for securing the connector to a socket. The locking member comprising a latching finger attached to the side wall. The latching finger extends in the direction of the insertion end of the insulated elongated member. The latching finger has a ridge directed towards the opposite side wall in the extended portion of the latching finger.

13 Claims, 3 Drawing Sheets

CONNECTOR APPARATUS HAVING LOCKING MEMBER

CROSS REFERENCE TO RELATED APPLICATIONS

This application is a national stage filing under 35 U.S.C. 371 of PCT/US2007/077538, filed Sep. 4, 2007, which claims priority to Singapore Application No. 200606213-7, filed Sep. 8, 2006, the disclosure of which is incorporated by reference in its/their entirety herein.

TECHNICAL FIELD

The present invention relates to a connector and in particular to a serial connector for connecting with a serial Advanced Technology Attachment (ATA) socket.

BACKGROUND

Serial ATA has increasingly replaced parallel Integrated Drive Electronics (IDE) as the preferred method of connecting computer hard drives. Known Serial ATA connectors and sockets are mostly engaged without locking or securing the connector and socket together. When a lock is used a user is required to unlock the lock before the connector and socket can be decoupled. In tight spaces such as within computer cases unlocking the lock can be difficult.

It would be desirable to provide a serial ATA connector that can be decoupled without having to manually unlock the lock.

SUMMARY

In accordance with one embodiment there is provided a connector for connecting with a serial ATA socket, the socket having end walls and an indent in each end wall, said connector comprising:

- an insulated elongated member, said member having a first wall, an opposite second wall, first and second side walls and an insertion end;
- a plurality of contacts within said insulated elongated member extending in the direction of said insertion end; and
- a locking member on at least one side wall for securing said connector to said socket, said locking member comprising a latching finger attached to said side wall, said latching finger extending in the direction of said insertion end of said insulated elongated member, said latching finger having a ridge directed towards the opposite side wall in the extended portion of said latching finger.

The ridge preferably has a peak, a first surface and a second surface, said first surface sloping away from said latching finger plane towards the peak of said ridge towards said insertion end and said second surface sloping away from the peak of said ridge towards said latching finger plane towards said insertion end.

There is preferably a locking member at each side wall.

When said connector and said serial ATA socket are engaged preferably the ridge locates in an indent in the corresponding side wall of said socket.

The force required for unlocking said connector from said serial ATA socket is preferably greater than 20 Newton.

The force required for unlocking said connector from said serial ATA socket is preferably 25 Newton.

The contacts preferably provide for electrical and data connection.

The locking member is preferably formed from sheet metal and assembled to said serial ATA connector.

The locking member is preferably formed from sheet metal.

The mating socket is preferably located on a circuit board.

In accordance with another embodiment there is provided a Serial ATA cable having: at least one connector, said connector comprising:

- an insulated elongated member, said member having a first wall, an opposite second wall, first and second side walls and an insertion end;
- a plurality of contacts within said insulated elongated member extending in the direction of said insertion end; and
- a locking member on at least one side wall for securing said connector to a serial ATA socket, said locking member comprising a latching finger attached to said side wall, said latching finger extending in the direction of said insertion end of said insulated elongated member, said latching finger having a ridge directed towards the opposite side wall in the extended portion of said latching finger.

There is preferably a locking member at each side wall.

In accordance with another embodiment there is provided a connector for connecting with a serial ATA socket, the socket having end walls and an indent in each end wall, said connector comprising:

- an insulated elongated member, said member having a first wall, an opposite second wall, first and second side walls and an insertion end;
- a plurality of contacts within said insulated elongated member extending in the direction of said insertion end; and
- a locking member on at least one side wall for securing said connector to said socket, said locking member comprising a latching finger attached to said side wall, said latching finger extending in the direction of said insertion end of said insulated elongated member, said latching finger having a ridge directed towards the opposite side wall in the extended portion of said latching finger,
- wherein said ridge has a peak, a first surface and a second surface, said first surface sloping away from said latching finger plane towards the peak of said ridge towards said insertion end and said second surface sloping away from the peak of said ridge towards said latching finger plane towards said insertion end, and
- wherein when said connector and said socket are engaged said ridge locates in an indent in the corresponding side wall of said socket.

There is preferably a locking member at each side wall.

The invention may further be said to consist in any alternative combination of parts or features mentioned herein or shown in the accompanying drawings. Known equivalents of these parts or features which are not expressly set out are nevertheless deemed to be included.

BRIEF DESCRIPTION OF THE DRAWINGS

An exemplary form of the present invention will now be described with reference to the accompanying drawings in which.

DETAILED DESCRIPTION

Figure 1:
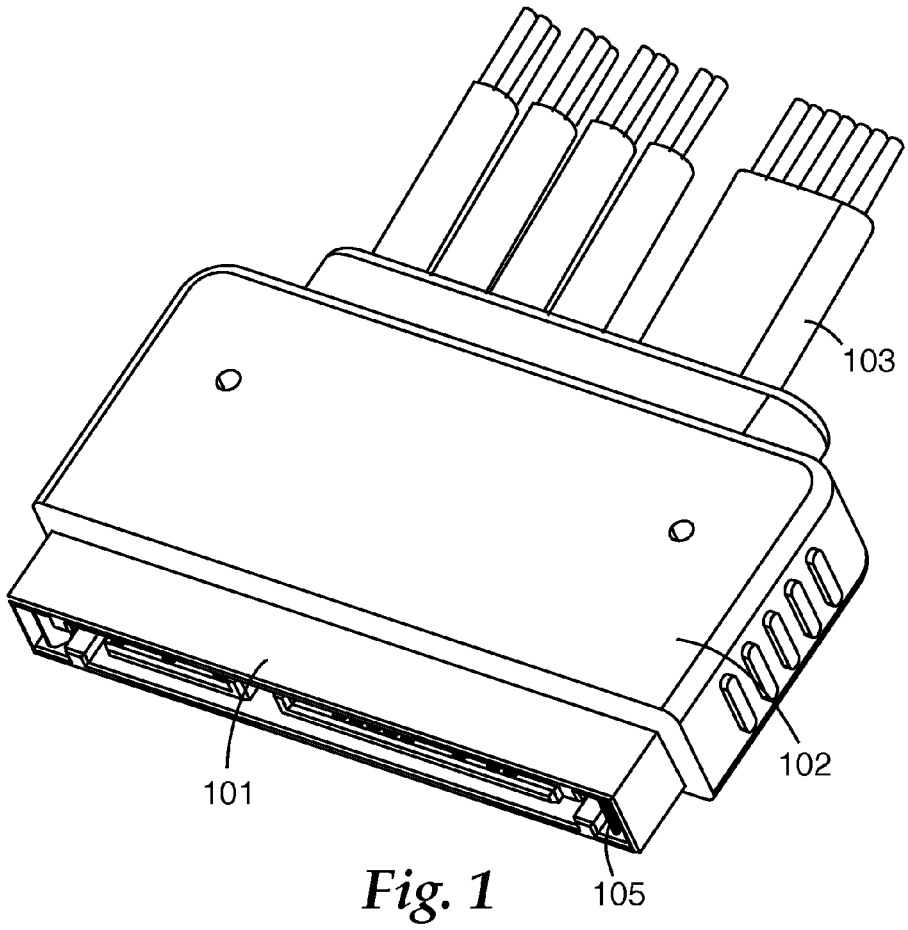
FIG. 1 is a perspective view of the an exemplary connector of the present invention.
Figure 2:
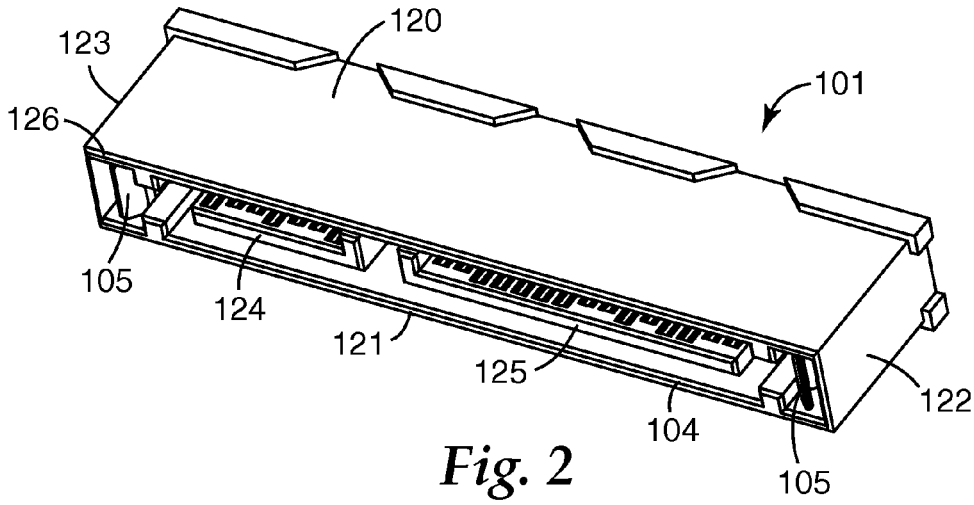
FIG. 2 is a perspective view of the an exemplary connector of the present invention.

Referring to FIG. 1 and FIG. 2 an exemplary connector is illustrated. The connector 101 is assembled with a plastic sheath 102; cables 103 pass through the sheath 102 to connect with a plurality of contacts 124, 125. The connector 101 is preferably a Serial ATA connector and may include contacts for power in addition to data path contacts.

The connector 101 is generally an elongated insulated member 104. The connector 101 has a first wall 120 and a second wall 121 opposite the first wall 120. The connector 101 also has first side wall 122 and second side wall 123. When the connector 101 and a socket connect the insertion end 126 mates with the socket first.

A locking member 105 is located at least at one side wall. Preferably, a locking member 105 is located at each side wall 122,123. In use the locking member 105 secures the connector 101 to a socket.

Referring to FIGS. 1 to 5 the end 165 of the locking member 105 extends in the direction of the insertion end 126. The locking member 105 has a latching finger 163 having a ridge 160. The base 166 couples the latching finger 163 to the elongated insulated member 104. The ridge 160 of each locking member 105 is directed towards the ridge 160 of the opposite locking member 105. The ridge 160 has a first sloping surface 161 and a second sloping surface 162. The first sloping surface 161 slopes towards the ridge peak 167 in the direction of the insertion end 126. The second sloping surface 162 slopes away from the ridge peak 167 towards the plane of the locking member 168 in the direction of the insertion end 126.

The locking members 105 can be made of sheet metal and integrally assembled with the elongated insulated member 104. The locking members 105 may be cantilevered. The locking members 105 may be biased towards each other so that a force is exerted by the locking members 105 towards the centre of the connector 101.

Figure 3:
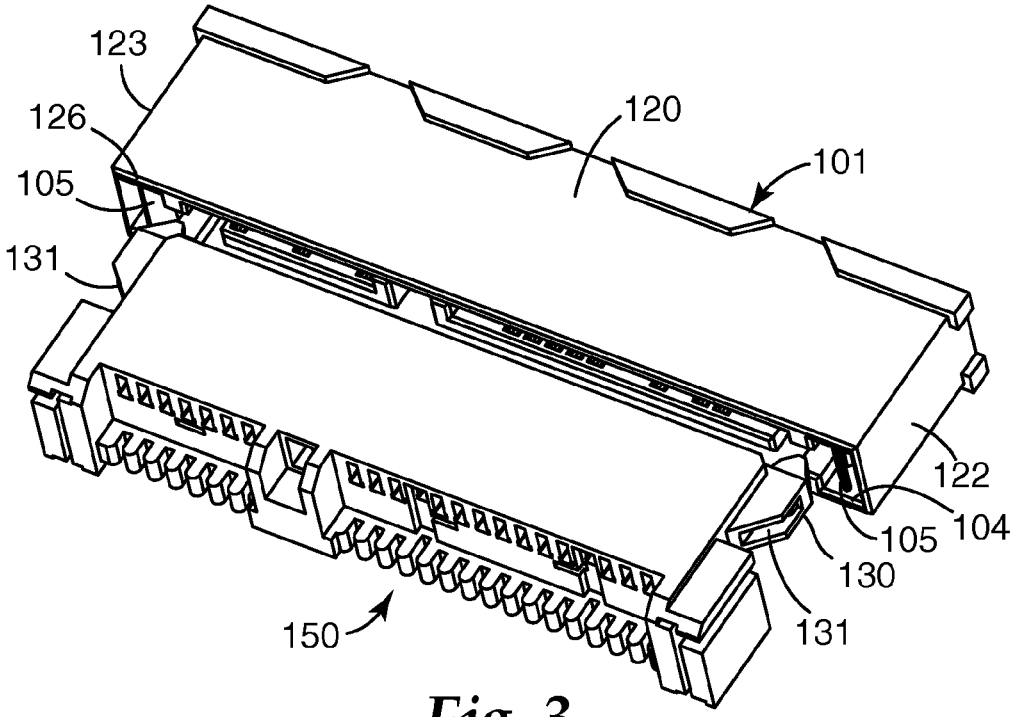
FIG. 3 is a partial perspective view of an exemplary connector of the present invention and a socket prior to engaging.
Figure 4:
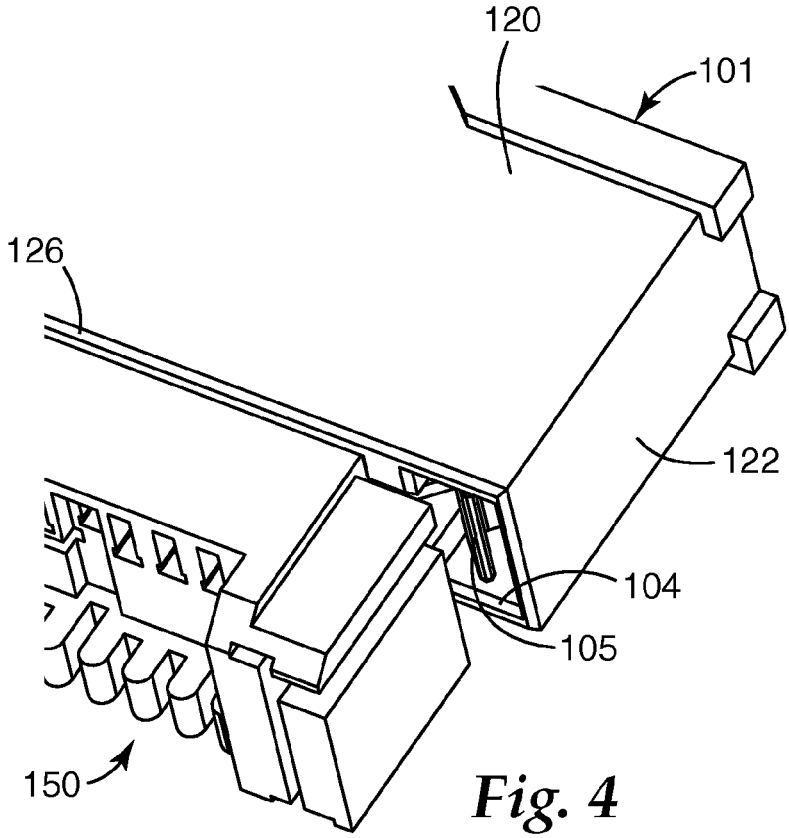
FIG. 4 is a partial perspective view of an exemplary connector of the present invention engaging with a socket.
Figure 5:
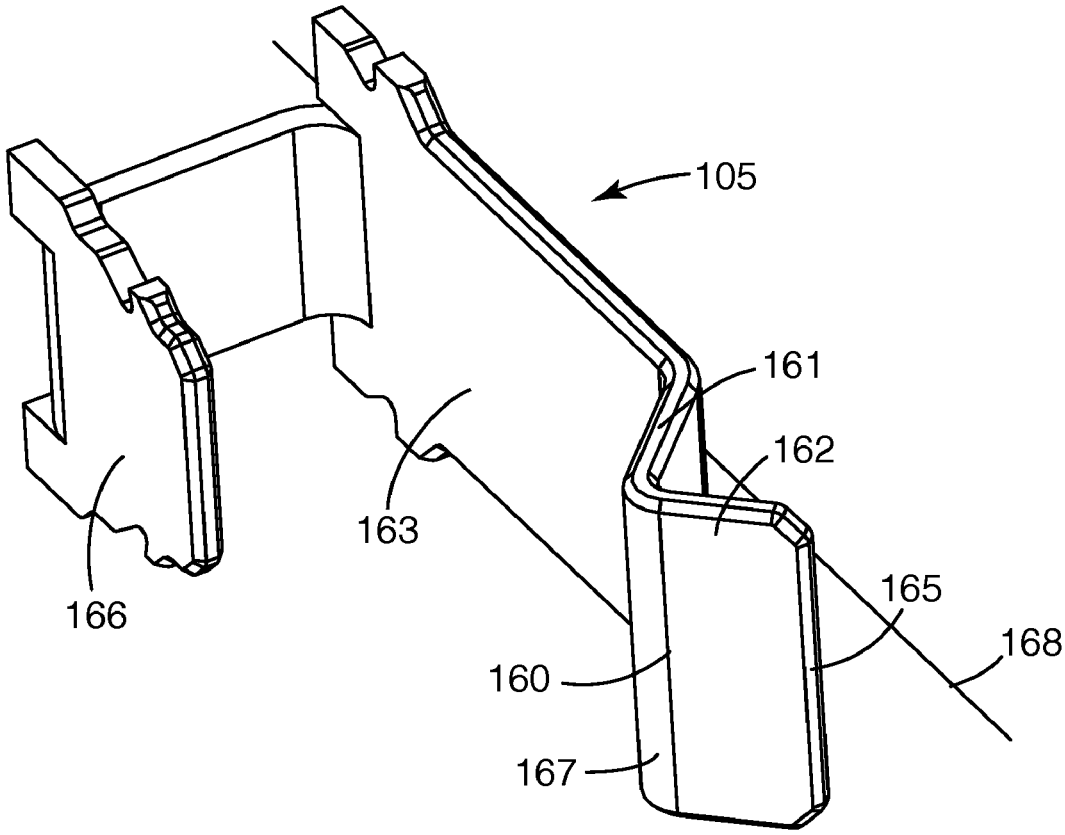
FIG. 5 is a perspective view of an exemplary locking member of the present invention.

Referring particularly to FIGS. 3 and 4 a serial ATA socket 150 has at each side 130 an indent 131. The indents 131 preferably slope towards each other away from the sides 130 of the socket 150. The socket 150 may be of a type located on a circuit board, in particular a computer motherboard.

When engaging the connector 101 and a socket 150, as the connector 101 and the socket 150 come together the second sloping surface 162 of each locking member 105 pushes the ridge 160 outwards away from the side 130 of the socket 150.

As the socket 150 and the connector 101 come further together the peak 167 of the ridge 160 slides into the indent 131 of the socket 150. When the socket 150 and the connector 101 are fully engaged the locking members 105 secure the connector 101 and the socket 150 together.

To unlock the connector 101 from the socket 150 the connector 101 is pulled in a direction opposite the insertion end 126. As the connector 101 is pulled the first sloping surface 161 of the locking member 105 ridge 160 slides up the sloping surface of the indents 131. Because both surfaces are sloped the locking member 105 is pushed out and the connector 101 and the socket 150 can be separated.

The connector 101 is well secured if the force required to unlock the connector 101 is in excess of about 20 Newton. The applicant has identified a force about 25 Newton to be preferable.

The foregoing description of the preferred embodiment of the invention has been presented for purposes of illustration and description. It is not intended to be exhaustive or to limit the invention to the precise forms disclosed, since many modifications or variations thereof are possible in light of the above teaching. All such modifications and variations are within the scope of the invention. The embodiments described herein were chosen and described in order best to explain the principles of the invention and its practical application, thereby to enable others skilled in the art to utilise the invention in various embodiments and with various modifications as are suited to the particular use contemplated thereof. It is intended that the scope of the invention be defined by the claims appended hereto, when interpreted in accordance with the fill breadth to which they are legally and equitably suited.

The invention claimed is:

1. A connector for connecting with a serial ATA socket, the socket having end walls and an indent in each end wall, said connector comprising:

an insulated elongated member, said member having a first wall, an opposite second wall, first and second side walls and an insertion end;

a plurality of contacts within said insulated elongated member extending in the direction of said insertion end; and a locking member surrounded by solid sections of one side wall and the first and second walls for securing said connector to said socket, said locking member comprising a latching finger attached to said side wall and defining a locking member plane, said latching finger extending in the direction of said insertion end of said insulated elongated member, said latching finger having a ridge directed towards the opposite side wall in the extended portion of said latching finger.

2. A connector as claimed in claim 1 wherein there is a locking member at each side wall.

3. A connector as claimed in claim 1 wherein said ridge has a peak, a first surface and a second surface, said first surface sloping away from said locking member plane and toward the peak of said ridge in the direction toward said insertion end and said second surface sloping away from the peak of said ridge and toward said locking member plane in the direction toward said insertion end.

4. A connector as claimed in claim 1 wherein when said connector and said serial ATA socket are engaged said ridge locates in an indent in the corresponding side wall of said socket.

5. A connector as claimed in claim 1 wherein the force required for unlocking said connector from said serial ATA socket is greater than 20 Newton.

6. A connector as claimed in claim 1 wherein the force required for unlocking said connector from said serial ATA socket is about 25 Newton.

7. A connector as claimed in claim 1 wherein said contacts provide for electrical and data connection.

8. A connector as claimed in claim 1 wherein said locking member is formed from sheet metal and assembled to said serial ATA connector.

9. A connector as claimed in claim 1 wherein said locking member is formed from sheet metal.

10. A connector as claimed in claim 1 wherein said mating socket is located on a circuit board.

11. A Serial ATA cable having: at least one connector, said connector comprising:

an insulated elongated member, said member having a first wall, an opposite second wall, first and second side walls and an insertion end;

a plurality of contacts within said insulated elongated member extending in the direction of said insertion end; and a locking member surrounded by solid sections of one side wall and the first and second walls for securing said connector to a serial ATA socket, said locking member comprising a latching finger attached to said side wall and defining a locking member plane, said latching finger extending in the direction of said insertion end of said insulated elongated member, said latching finger having a ridge directed towards the opposite side wall in the extended portion of said latching finger.

12. A Serial ATA cable as claimed in claim 11 wherein there is a locking member at each side wall.

13. A connector for connecting with a serial ATA socket, the socket having end walls and an indent in each end wall, said connector comprising:

an insulated elongated member, said member having a first wall, an opposite second wall, first and second side walls and an insertion end;

a plurality of contacts within said insulated elongated member extending in the direction of said insertion end; and a locking member on at least one side wall for securing said connector to a socket, said locking member comprising a latching finger attached to said side wall, said latching finger extending in the direction of said insertion end of said insulated elongated member, said latching finger having a ridge directed towards the opposite side wall in the extended portion of said latching finger, wherein said ridge has a peak, a first surface and a second surface, said first surface sloping away from said locking member plane and toward the peak of said ridge in the direction toward aid insertion end and said second surface sloping away from the peak of said ridge and toward said locking member plane in the direction toward said insertion end, and wherein when said connector and said socket are engaged said ridge locates in an indent in the corresponding side wall of said socket.

* * * * *

UNITED STATES PATENT AND TRADEMARK OFFICE

CERTIFICATE OF CORRECTION

PATENT NO. : 7,934,938 B2
APPLICATION NO. : 12/376280
DATED : May 3, 2011
INVENTOR(S) : Saujit Bandhu It is certified that error appears in the above-identified patent and that said Letters Patent is hereby corrected as shown below:

Column 6,
Line 16, Claim 13, delete “aid” and insert --said-- therefor.

Signed and Sealed this
Sixth Day of September, 2011

David J. Kappos

David J. Kappos
*Director of the United States Patent and Trademark Office*